US010975604B2

(12) United States Patent
Kashiwagi et al.

(10) Patent No.: US 10,975,604 B2
(45) Date of Patent: Apr. 13, 2021

(54) WINDOW REGULATOR

(71) Applicant: Johnan Manufacturing Inc., Nagano (JP)

(72) Inventors: Hideaki Kashiwagi, Nagano (JP); Hideaki Takehara, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 0 days.

(21) Appl. No.: 16/777,018

(22) Filed: Jan. 30, 2020

(65) Prior Publication Data

US 2020/0256103 A1 Aug. 13, 2020

(30) Foreign Application Priority Data

Feb. 8, 2019 (JP) ..... JP2019-021856

(51) Int. Cl.
*E05D 15/16* (2006.01)
*E05F 11/48* (2006.01)
*E05F 15/689* (2015.01)

(52) U.S. Cl.
CPC ..... *E05D 15/165* (2013.01); *E05F 11/485* (2013.01); *E05F 15/689* (2015.01); *E05Y 2900/55* (2013.01)

(58) Field of Classification Search
CPC ..... E05F 11/488; E05F 11/485; E05F 11/486; E05F 11/483; E05F 11/382; E05F 11/445; E05F 15/689
See application file for complete search history.

(56) References Cited

U.S. PATENT DOCUMENTS

| | | | | |
|---|---|---|---|---|
| 4,403,450 | A * | 9/1983 | Ishii | E05F 11/485 49/352 |
| 5,617,675 | A * | 4/1997 | Kobrehel | E05F 11/485 49/352 |
| 9,677,312 | B2 * | 6/2017 | Marsh | E05F 11/485 |
| 9,803,683 | B2 * | 10/2017 | Simonneau | E05F 7/08 |
| 2013/0283698 | A1 | 10/2013 | Huber et al. | |
| 2019/0136598 | A1 * | 5/2019 | Kinoshita | E05F 11/382 |
| 2019/0136599 | A1 * | 5/2019 | Kinoshita | E05F 11/483 |

FOREIGN PATENT DOCUMENTS

| | | |
|---|---|---|
| JP | 1978-011596 U | 0/1978 |
| JP | H1-154788 U | 10/1989 |

OTHER PUBLICATIONS

Office Action issued in the corresponding Japanese Patent Application No. 2019-021856 dated Dec. 1, 2020.

* cited by examiner

*Primary Examiner* — Justin B Rephann
(74) *Attorney, Agent, or Firm* — Roberts Calderon Safran & Cole P.C.

(57) ABSTRACT

A window regulator includes a guide rail provided along an ascending/descending direction of a window for a vehicle, a carrier plate that slides on the guide rail and moves together with the window, a window power feed wire for supplying power to the window, a swing bar arranged to be swingable about the rotational axis thereof that is along a width direction of the vehicle, and an elastic member that generates an elastic force for oscillation the swing bar in a predetermined direction. The window power feed wire is hung over the swing bar, and a tension is applied to the window power feed wire by oscillation of the swing bar due to the elastic force of the elastic member.

5 Claims, 16 Drawing Sheets

WINDOW REGULATOR

CROSS-REFERENCE TO RELATED APPLICATIONS

The present application is based on Japanese patent application No. 2019-021856 filed on Feb. 8, 2019, the entire contents of which are incorporated herein by reference.

TECHNICAL FIELD

The invention relates to a window regulator.

BACKGROUND ART

A window regulator is known which is provided with a guide rail, a carrier plate moving together with a window along the guide rail, a motor driving the carrier plate, a motor power feed wire for supplying power to the motor, and a wire reel for feeding out and taking up the motor power feed wire (see, e.g., JP H1/154788 U).

The wire reel has a rotating pulley for taking up the motor power feed wire, a spiral spring for providing a force to take up the motor power feed wire, and a cover constituting the outer frame, and the force of the spiral spring prevents the motor power feed wire from being slack. This prevents noise caused by contact between the slack motor power feed wire and the inner wall or members of the door and also prevents damage on the motor power feed wire.

Also, the rotating pulley is provided with a contact structure in which a lead wire connected to a battery on a vehicle body to supply power to the motor power feed wire is electrically connected to the motor power feed wire. The inside of the rotating pulley is configured such that a brush provided on the lead wire is in sliding contact with an electrode provided on the motor power feed wire. When the rotating pulley rotates, the brush comes in sliding contact with the electrode and power is thereby supplied to the motor power feed wire. The cover mentioned above provides waterproof for the contact structure.

SUMMARY OF INVENTION

The motor regulator described in JP H1/154788 U may cause a problem that the structure of the wire reel is complicated due to the contact structure of the lead wire and the motor power feed wire provided inside the wire reel. Also, if the contact structure is provided outside the wire reel, another waterproofing structure therefor may be needed which is different from the waterproofing structure for the wire reel. In the present invention, a window power feed wire is used for supplying power to a vehicle door window and may have a slack so that the window power feed wire comes into contact with other components inside the door panel and makes noise when closing the door.

It is an object of the invention to provide a window regulator that can prevent the slack of the window power feed wire while having a simple structure.

According to an aspect of the invention, a window regulator comprises:

- a guide rail provided along an ascending/descending direction of a window for a vehicle;
- a carrier plate that slides on the guide rail and moves together with the window;
- a window power feed wire for supplying power to the window;

- a swing bar arranged to be swingable about the rotational axis thereof that is along a width direction of the vehicle; and
- an elastic member that generates an elastic force for oscillation the swing bar in a predetermined direction;
- wherein the window power feed wire is hung over the swing bar, and a tension is applied to the window power feed wire by oscillation of the swing bar due to the elastic force of the elastic member.

According to an embodiment of the invention, a window regulator can be provided that can prevent the slack of the window power feed wire while having a simple structure.

BRIEF DESCRIPTION OF DRAWINGS

FIGS. 7A to 7D are two-dimensional diagrams illustrating the configuration of the carrier plate, wherein FIG. 7A is a top view, FIG. 7B is a front view, FIG. 7C is a right side view and FIG. 7D is a back view.

FIGS. 9A to 9C are two-dimensional diagrams illustrating the configuration of the drum housing, wherein FIG. 9A is a top view, FIG. 9B is a front view and FIG. 9C is a right side view.

FIGS. 11A and 11B are two-dimensional diagrams illustrating the configuration of the rail portion, wherein FIG. 11A is a back view and FIG. 11B is a bottom view.

FIGS. 13A to 13F two-dimensional diagrams illustrating the configuration of the upper end cover, wherein FIG. 13A is a top view, FIG. 13B is a front view, FIG. 13C is a bottom view, FIG. 13D is a left side view, FIG. 13E is a right side view and FIG. 13F is a back view.

FIGS. 15A to 15D are two-dimensional diagrams illustrating the configuration of the locking portion, wherein FIG. 15A is a front view, FIG. 15B is a bottom view, FIG. 15C is a back view and FIG. 15D is a right side view.

FIGS. 17A to 17E are two-dimensional diagrams illustrating the configuration of the lower end cover of the swing bar, wherein FIG. 17A is a top view, FIG. 17B is a front view, FIG. 17C is a bottom view, FIG. 17D is a right side view and FIG. 17E is a back view.

18A shows the initial state, FIG. 18B shows the state immediately after the carrier plate started to move upward from the initial state, FIG. 18C shows the state in which the carrier plate is located at its top dead center, and FIG. 18D shows the state in which the carrier plate is located at its bottom dead center.

FIGS. 19A to 19C are explanatory diagrams illustrating motion of a window regulator in the second embodiment, particularly, motion of the swing bar with movement of the carrier plate, wherein FIG. 19A shows the state in which the carrier plate is located at the bottom dead center, FIG. 19B shows the state in which the carrier plate is located at an intermediate position between the top dead center and the bottom dead center, and FIG. 19C shows the state in which the carrier plate is located at the top dead center.

FIGS. 20A and 20B are two-dimensional diagrams illustrating a configuration of a pulley bracket of the window regulator in the second embodiment, wherein FIG. 24A is a front view and FIG. 20B is a bottom view.

FIGS. 22A to 22C are explanatory diagrams illustrating motion of a window regulator in the third embodiment, particularly, motion of the swing bar with movement of the carrier plate, wherein FIG. 22A shows the state in which the carrier plate is located at the bottom dead center, FIG. 22B shows the state in which the carrier plate is located at an intermediate position between the top dead center and the bottom dead center, and FIG. 22C shows the state in which the carrier plate is located at the top dead center.

DESCRIPTION OF EMBODIMENTS

First Embodiment

A window regulator 1 in the first embodiment is a device for raising and lowering a window 90 on a door 9 of, e.g., a vehicle such as an automobile and is installed on a door panel of the automobile.

(General Configuration of the Window Regulator)

Figure 1:
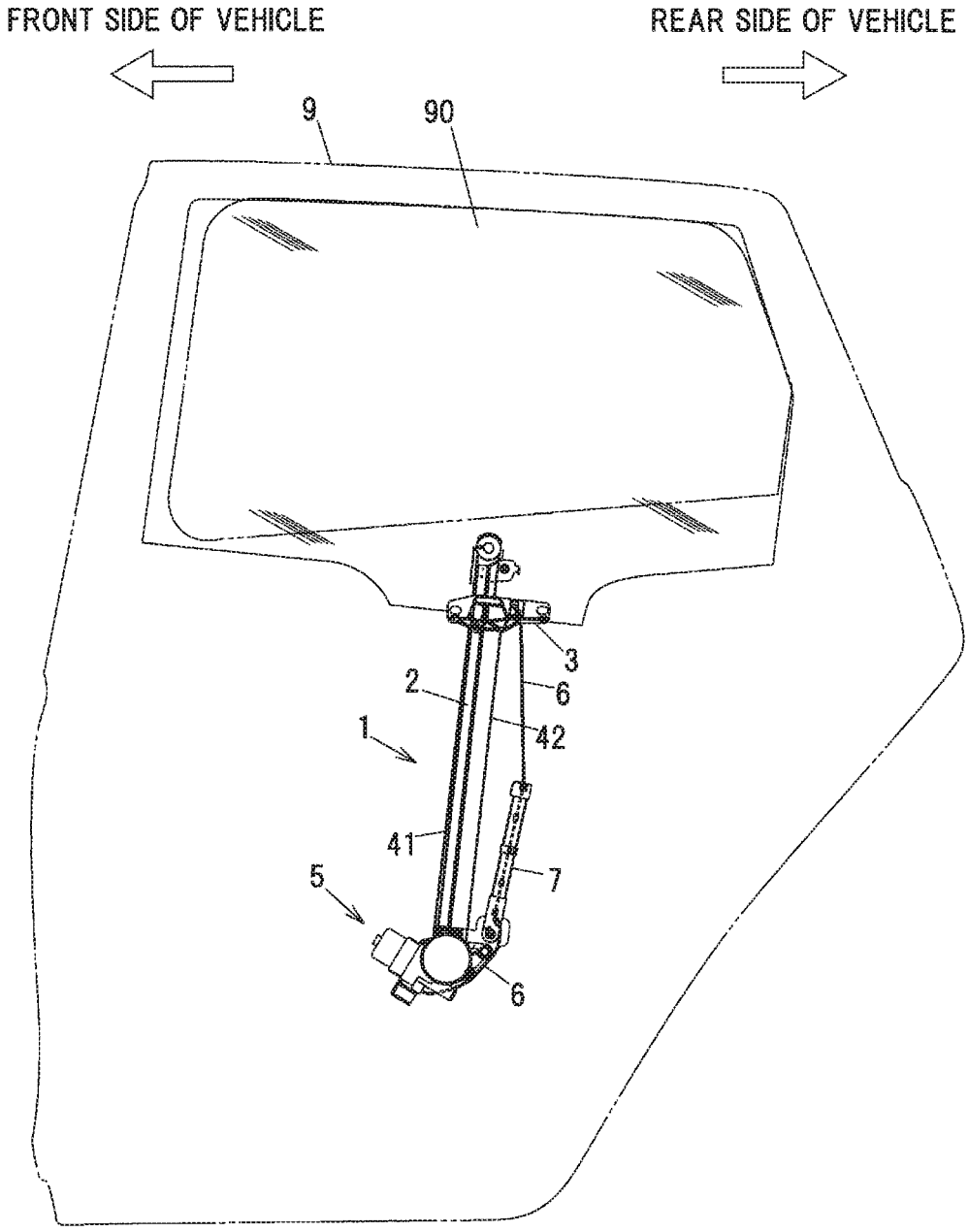
FIG. 1 is a general schematic diagram illustrating a window regulator in the first embodiment of the present invention and a vehicle door mounting the window regulator.
Figure 4:
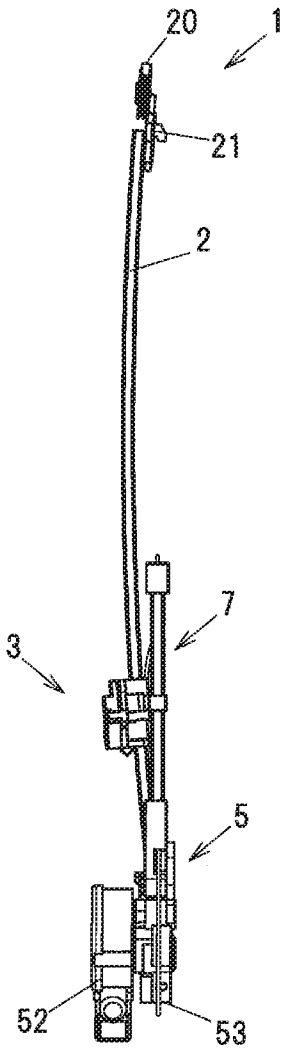
FIG. 4 is a side view showing the configuration of the window regulator in the first embodiment.
Figure 3:
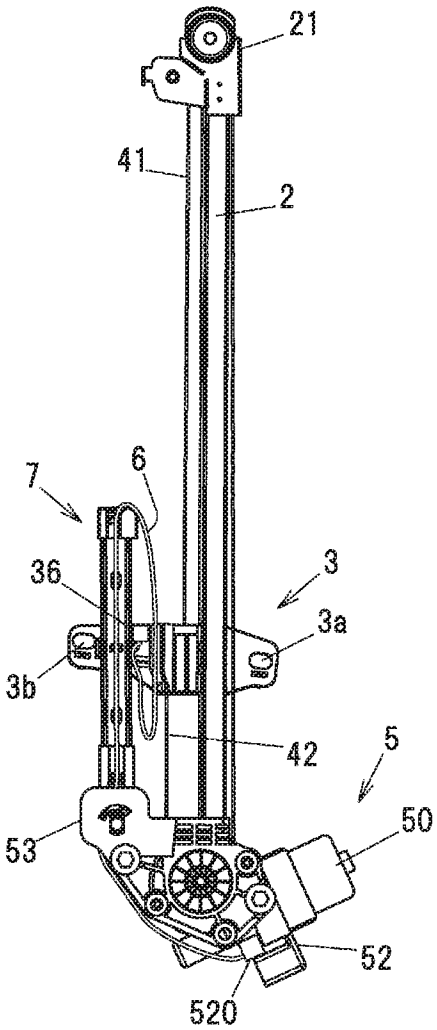
FIG. 3 is a back view showing the configuration of the window regulator in the first embodiment.
Figure 2:
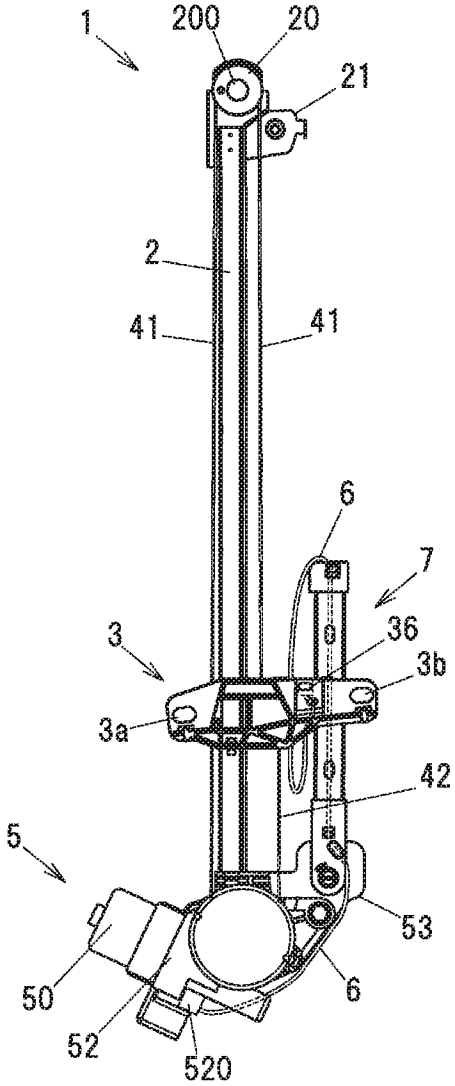
FIG. 2 is a front view showing a configuration of the window regulator in the first embodiment.
Figure 5:
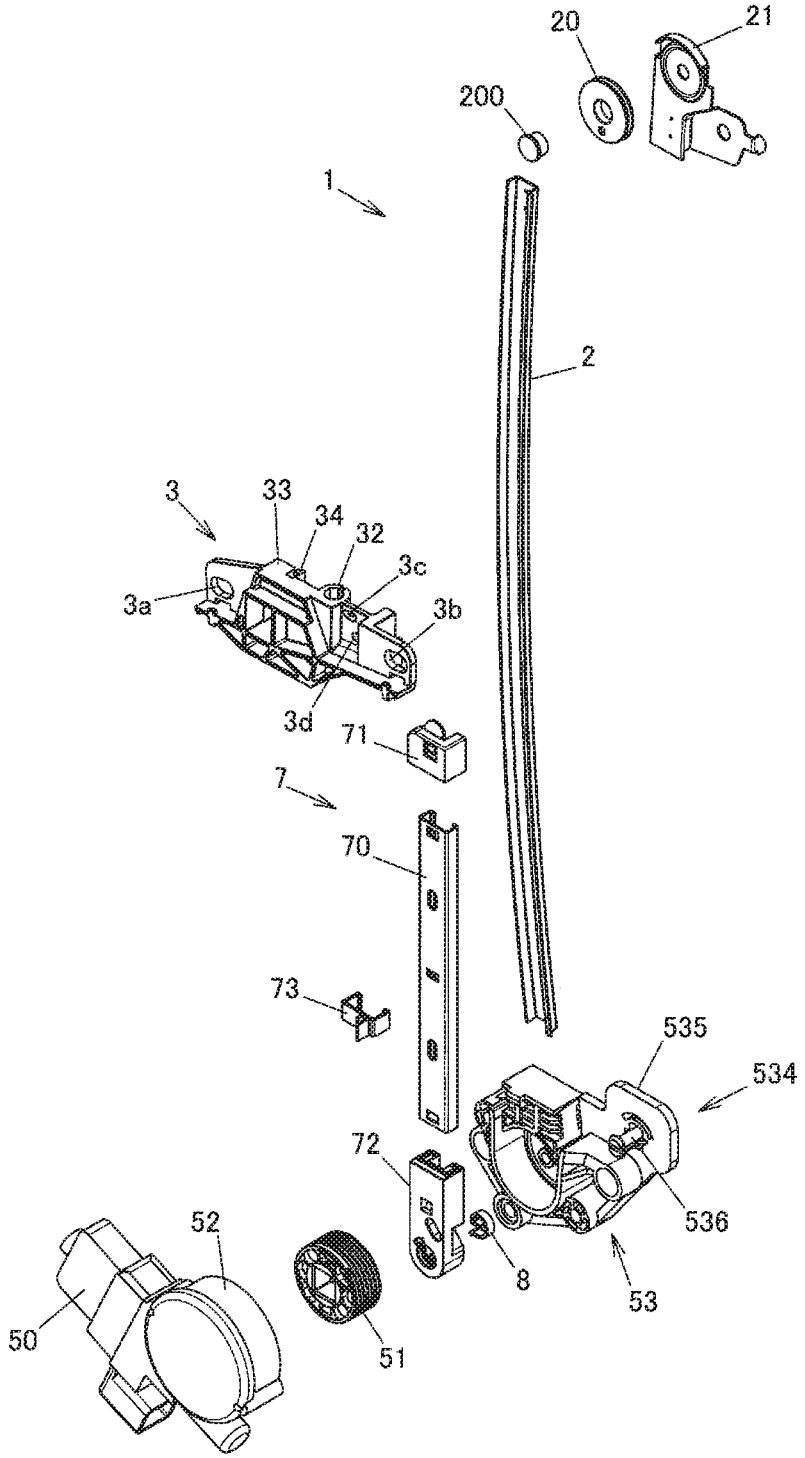
FIG. 5 is an exploded perspective view showing the configuration of the window regulator.

FIG. 1 is a general schematic diagram illustrating the window regulator 1 in the first embodiment and the door 9 of a vehicle mounting the window regulator 1. FIG. 2 is a front view showing a configuration of the window regulator in the first embodiment. FIG. 3 is a back view showing the configuration of the window regulator 1 in the first embodiment. FIG. 4 is a side view showing the configuration of the window regulator 1 in the first embodiment. FIG. 5 is an exploded perspective view showing the configuration of the window regulator 1. In FIG. 1, the window 90 is in a fully-closed state, and the door 9 and a window frame are indicated by phantom lines. In addition, in FIG. 1, the left side of the paper is defined as the front side in the vehicle longitudinal direction and the right side of the paper is defined as the rear side in the vehicle longitudinal direction. In FIGS. 2 to 4, illustration of the window 90 is omitted for convenience of explanation. In the following description, an ascending/descending direction of a window 90 is simply referred to as "the vertical direction".

As shown in FIG. 1, the window regulator 1 is provided with a guide rail 2 which is housed in a door panel (not shown) provided on the door 9 of the vehicle and is arranged along the ascending/descending direction of the window 90 of the vehicle, a carrier plate 3 which slides on the guide rail 2 and moves together with the window 90, an ascending-side cable 41 and a descending-side cable 42 which pull the carrier plate 3, a drive unit 5 which generates a driving force for taking up and feeding out the ascending-side cable 41 and the descending-side cable 42, a window power feed wire 6 for feeding power to the window 90, a swing bar 7 arranged to be swingable with respect to the drive unit 5 and swings in a predetermined direction to remove slack of the window power feed wire 6, and an elastic member 8 for applying an elastic force to the swing bar 7.

(Guide Rail)

The guide rail 2 is a metal member formed by bending a long metal plate at a predetermined curvature and is arranged so as to tilt to the rear side in the vehicle longitudinal direction with respect to the door 9. The material of the guide rail 2 is not limited to metal and may be, e.g., a resin.

(Ascending-Side Cable and Descending-Side Cable)

The ascending-side cable 41 is coupled to the carrier plate 3 at one end, turns at a pulley 20 provided at the top end of the guide rail 2, and is coupled to a drum 51 (shown in FIG. 5) of the drive unit 5 (described later) at the other end. The descending-side cable 42 is coupled to the carrier plate 3 at one end and is coupled to the drum 51 at the other end. The pulley 20 is rotatably supported, via a rotating pin 200, on a pulley bracket 21 which is fixed to an upper end of the guide rail 2.

The ascending-side cable 41 and the descending-side cable 42 are arranged at positions not overlapping the guide rail 2 when viewed in a vehicle width direction. In other words, to reduce the weight, the guide rail 2 in the embodiment has a smaller length in the vehicle longitudinal direction than typical guide rails.

(Carrier Plate)

Figure 6:
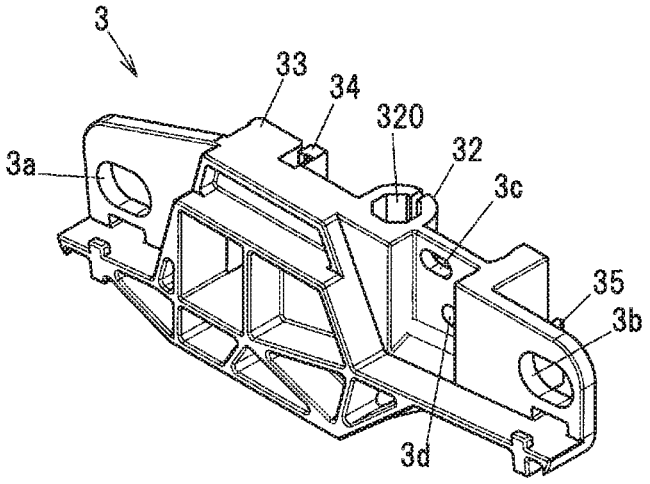
FIG. 6 is a perspective view showing a configuration of a carrier plate.
Figure 7A:
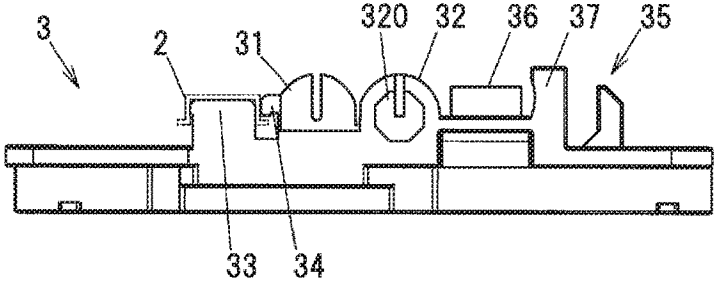
Figure 7B:
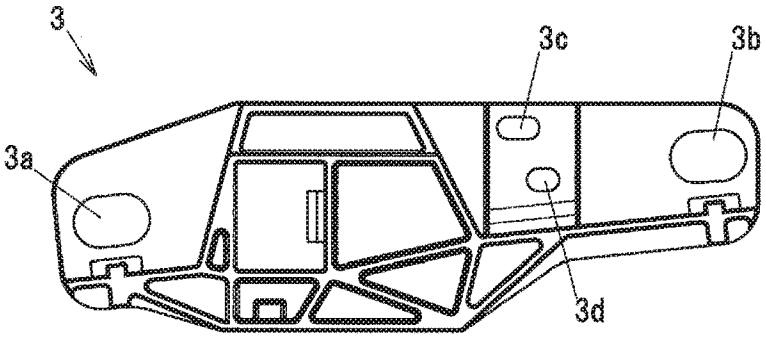
Figure 7C:
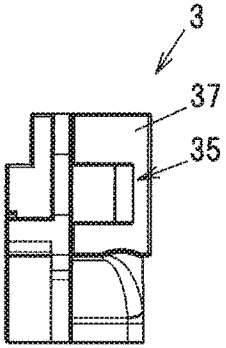
Figure 7D:
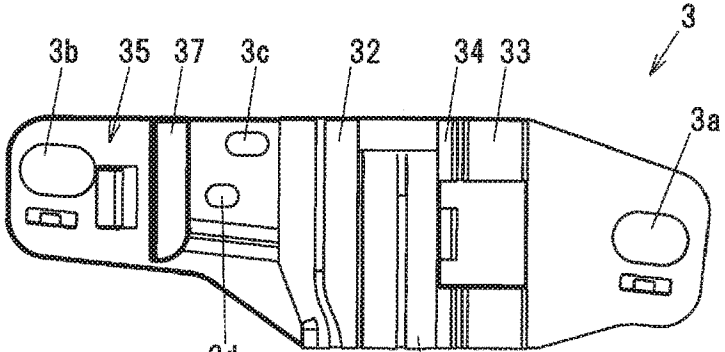

FIG. 6 is a perspective view showing a configuration of the carrier plate 3. FIGS. 7A to 7D are two-dimensional diagrams illustrating the configuration of the carrier plate 3, wherein FIG. 7A is a top view, FIG. 7B is a front view, FIG. 7C is a right side view and FIG. 7D is a back view.

The carrier plate 3 is a plate-shaped member formed of, e.g., a resin such as polyacetal. The carrier plate 3 has attachment holes 3*a* and 3*b* to which a glass holder (not shown) for coupling to the window 90 is fitted.

As shown in FIG. 7A, an ascending-side cylindrical portion 31 locking one end of the ascending-side cable 41 and a descending-side cylindrical portion 32 locking one end of the descending-side cable 42 are formed on the back surface (a surface facing the door panel of the door 9) of the carrier plate 3. The descending-side cylindrical portion 32 has a descending-side housing hole 320 in which the one end of the descending-side cable 42 and a coil spring (not shown) for applying tension to the descending-side cable 42 are housed. Also the ascending-side cylindrical portion 31 has a housing hole formed in the same manner.

A sliding portion 33 allowing the guide rail 2 (indicated by a phantom line) to slide thereon and a guide rail locking portion 34 protruding from a side surface of the ascending-side cylindrical portion 31 and locking one end of the guide rail 2 in the vehicle longitudinal direction are provided on the carrier plate 3 at a position adjacent to the ascending-side cylindrical portion 31. The sliding portion 33 protrudes in a raised manner from the back surface of the carrier plate 3.

A power feed connector 36 connected to one end of the window power feed wire 6 is attached to the carrier plate 3 at a position adjacent to the descending-side cylindrical portion 32. The power feed connector 36 is fixed to the back surface of the carrier plate 3 through an attachment hole 3*c* formed on the carrier plate 3. A carrier fixing hole 3*d* for fixing the window power feed wire 6 to the back surface of the carrier plate 3 is also formed on the carrier plate 3 at the position adjacent to the descending-side cylindrical portion 32. A fixing member (not shown) for fixing the window power feed wire 6 is fixed in the carrier fixing hole 3*d*.

A protrusion 35 which holds the swing bar 7 in a predetermined position by coming into contact with a locking portion 73 of the swing bar 7 (described later) is provided on the carrier plate 3 at a position adjacent to the power feed connector 36 on the opposite side to the descending-side cylindrical portion 32. Furthermore, a carrier wire support portion 37 for supporting the window power feed wire 6 in tension is provided between the power feed connector 36 and the protrusion 35. The carrier wire support portion 37 is formed such that an end thereof has an arc shape. This allows the window power feed wire 6 to smoothly extend out of the carrier plate 3. That is, excessive bend and resulting wire breakage are prevented at a portion where the window power feed wire 6 extending out of the carrier plate 3 turns to change the direction.

(Drive Unit)

As shown in FIG. 5, the drive unit 5 has a motor 50, the drum 51 rotated by the motor 50 to take up and feed out the ascending-side cable 41 and the descending-side cable 42, a motor housing 52 holding the motor 50, and a drum housing 53 fixed to a lower end of the guide rail 2 and accommodating the drum 51.

A power supply connector 520 connected to the other end of the window power feed wire 6 is attached to the motor housing 52. An electrical cable such as harness connected to a battery mounted on the vehicle is connected to the power supply connector 520, and the window power feed wire 6 receives power via the power supply connector 520. Although the power supply connector 520 in the first embodiment is provided at a lower portion of the motor housing 52, the mounting position of the power supply connector 520 is not limited thereto.

(Drum Housing)

Figure 9A:
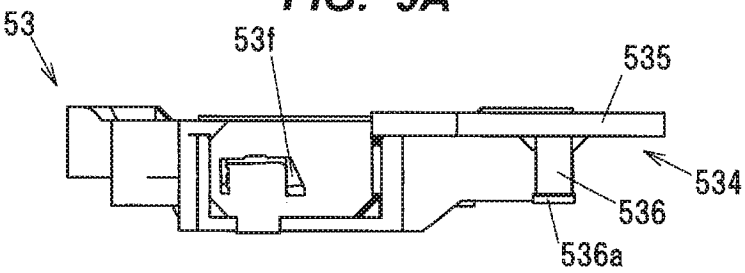
Figure 9B:
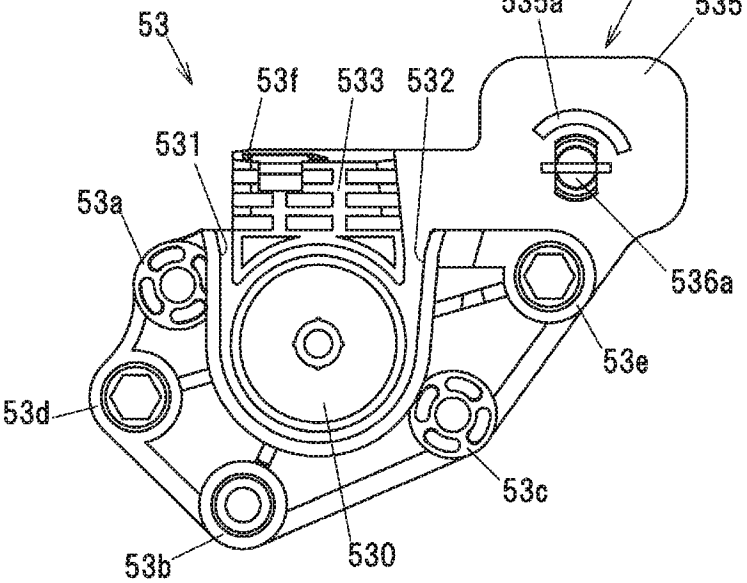
Figure 9C:
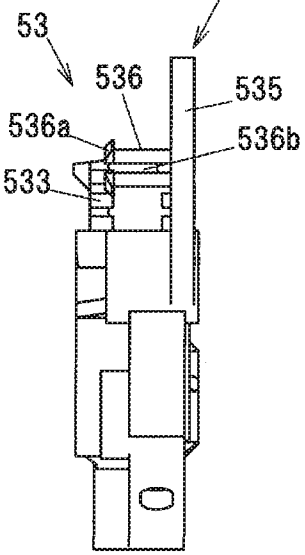
Figure 8:
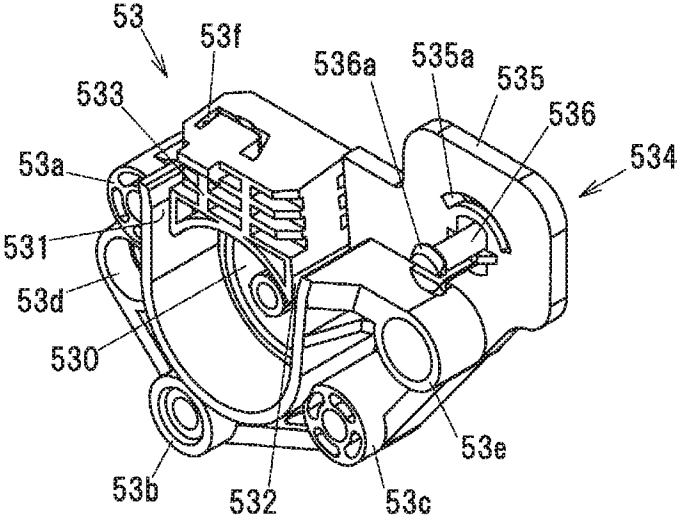
FIG. 8 is a perspective view showing a configuration of a drum housing.

FIG. 8 is a perspective view showing a configuration of the drum housing 53. FIGS. 9A to 9C are two-dimensional diagrams illustrating the configuration of the drum housing 53, wherein FIG. 9A is a top view, FIG. 9B is a front view and FIG. 9C is a right side view.

The drum housing 53 is a resin member and has a bottomed-cylindrical drum housing portion 530 for accommodating the drum 51, first to third motor fixing portions 53*a* to 53*c* for fixing to the motor housing 52, and fourth and fifth vehicle body fixing portions 53*d* and 53*e* for fixing to the door panel. Each fixing portion is fixed by a fastening member such as a bolt.

The drum housing 53 has an ascending-side exit 531 from which the ascending-side cable 41 wound around the drum 51 extends out of the drum housing 53, and a descending-side exit 532 from which the descending-side cable 42 also wound around the drum 51 extends out. The ascending-side exit 531 and the descending-side exit 532 are in communication with the drum housing portion 530.

A rib portion 533 for adding rigidity to the drum housing 53 is provided above the drum housing portion 530 of the drum housing 53. As shown in FIG. 9A, a fitting grove 53*f* for fitting the lower end of the guide rail 2 is formed on the upper surface of the rib portion 533.

The drum housing 53 has a support portion 534 for swingably supporting the swing bar 7. As shown in FIG. 9B, the support portion 534 is positioned on the right side relative to the rib portion 533 on the paper (on the vehicle rear side in FIG. 1).

The support portion 534 is composed of a plate-shaped base portion 535, and a shaft portion 536 which is a pivot point of the swing bar 7 and protrudes from the base portion 535. A through-hole 535*a* having an arc shape is formed on the base portion 535. A stopper 721*a* of a lower end cover 72 of the swing bar 7 (described later) is inserted into the through-hole 535*a* The elastic member 8 is attached to the shaft portion 536. In the first embodiment, the elastic member 8 is a spiral spring.

The shaft portion 536 protrudes along the vehicle width direction and is positioned at a predetermined distance from the guide rail 2 on the rear side in the vehicle longitudinal direction. In addition, a flange portion 536*a* having a slightly larger diameter than the shaft portion is provided at an end of the shaft portion 536. A gap 536*b* formed along the axial direction is formed on the shaft portion 536, and one end of the elastic member 8 is attached to the gap 536*b*.

(Swing Bar)

The swing bar 7 has a rail portion 70 formed of a metal, an upper end cover 71 attached to an upper end of the rail portion 70, the lower end cover 72 attached to a lower end of the rail portion 70, and the locking portion 73 attached to the middle of the rail portion 70.

The rail portion 70 is formed of a metal and is thus rigid, and this prevents bending due to, e.g., an impact in the vehicle width direction at the time of opening/closing the door 9. However, the material of the rail portion 70 is not limited to the metal and may be, e.g., a resin as long as the rail portion 70 has rigidity.

The swing bar 7 is arranged to be swingable about the rotational axis along the vehicle width direction. In more detail, the swing bar 7 can swing in a first direction and a second direction, where the first direction is a direction in which the upper end cover 71 as a free end located opposite to the lower end cover 72 as a swingably supported end comes close to the guide rail 2, and the second direction is a direction in which the upper end cover 71 moves away from the guide rail 2. The window power feed wire 6 extending out of the power feed connector 36 of the carrier plate 3 is hung over the upper end cover 71.

The swing bar 7 can swing within a predetermined angular range. In the first embodiment, the swing bar 7 swings between a first position/orientation corresponding to the top dead center of the carrier plate 3, a second position/orientation corresponding to the bottom dead center of the carrier plate 3, and a third position/orientation corresponding to a temporarily held state (described later). The third position/orientation is the position/orientation with which the upper end cover 71 of the swing bar 7 is located closest to the guide rail 2 and the swing bar 7 extends along the longitudinal direction of the guide rail 2. The first position/orientation is the position/orientation slightly inclined from the third position/orientation in the second direction. The second position/orientation is the position/orientation which is inclined by 90° from the third position/orientation in the second direction and is horizontal. Although the predetermined angular range between the third position/orientation and the second position/orientation is about 90° in the first embodiment, the swingable angular range of the swing bar 7 is not limited thereto and is appropriately set according to the circumferential length (along a circumferential direction about the rotational axis which is the center axis of the shaft portion 536 shown in FIG. 9 and described later) of the through-hole 535*a* formed on the drum housing 53 (described later).

The elastic member 8 constantly applies an elastic force to the swing bar 7 to cause the swing bar 7 to swing in the second direction. The motion of the swing bar 7 will be described in detail later in reference to FIG. 18.

Figure 11A:
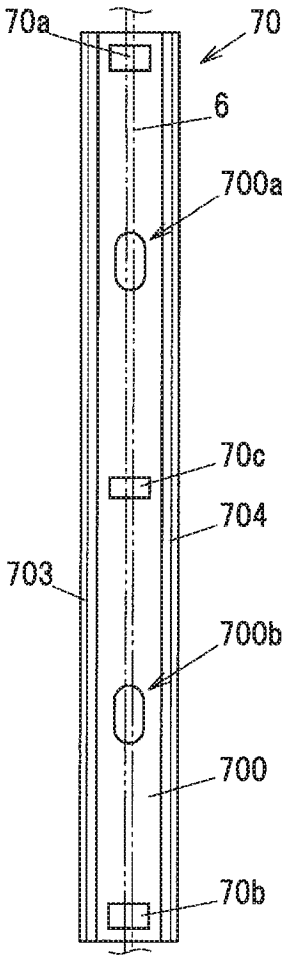
Figure 11B:
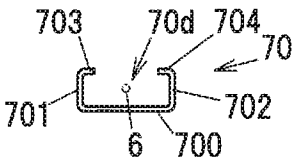
Figure 10:
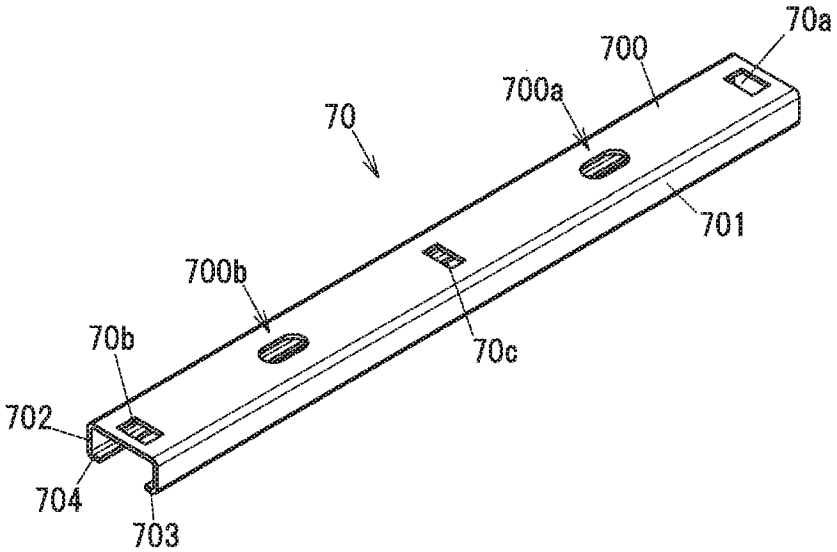
FIG. 10 is a perspective view showing a configuration of a rail portion of a swing bar.

FIG. 10 is a perspective view showing a configuration of the rail portion 70 of the swing bar 7. FIGS. 11A and 11B are two-dimensional diagrams illustrating the configuration of the rail portion 70, wherein FIG. 11A is a back view and FIG. 11B is a bottom view.

As shown in FIGS. 10 and 11B, the rail portion 70 integrally has a flat-plate portion 700 extending along the longitudinal direction thereof, first and second side plate portions 701 and 702 rising upright respectively from both edges of the flat-plate portion 700 which are the edges in a lateral direction of the rail portion 70, a first flange portion 703 projecting from an end of the first side plate portion 701 in a direction parallel to the flat-plate portion 700, and a second flange portion 704 projecting from an end of the second side plate portion 702 in the direction parallel to the flat-plate portion 700. The rail portion 70 of the swing bar 7 may be curved in a direction orthogonal to the flat-plate portion 700 of the rail portion 70 or in the lateral direction of the rail portion 70 depending on the shape or structure inside the door panel, and the shape of the rail portion 70 is appropriately set according to the shape or structure inside the door panel.

The first and second flange portions 703 and 704 project inwardly so as to come close to each other. The rail portion 70 has a squared U-shape when viewed in the longitudinal direction thereof.

A portion of the window power feed wire 6 (indicated by a phantom line in FIG. 11) routed between the power supply connector 520 and the power feed connector 36 is arranged on the rail portion 70 along the longitudinal direction. The window power feed wire 6 extending out of the lower end of the rail portion 70 is connected to the power supply connector 520, and the window power feed wire 6 extending out of the upper end of the rail portion 70 is connected to the power feed connector 36.

An upper-end through-hole 70*a* used for attaching the upper end cover 71 is formed on the rail portion 70 on the upper end side. A lower-end through-hole 70*b* used for attaching the lower end cover 72 is formed on the rail portion 70 on the lower end side. A center through-hole 70*c* used for attaching the locking portion 73 is formed at the center of the rail portion 70. Although the center through-hole 70*c* is provided at the center of the rail portion 70, the position of the center through-hole 70*c* may be changed according to the mounting position of the locking portion 73.

The rail portion 70 has a first fixing hole 700*a* and a second fixing hole 700*b* which are thrilled to fix the window power feed wire 6 to the flat-plate portion 700. The first fixing hole 700*a* is provided between the upper-end through-hole 70*a* and the center through-hole 70*c*, and the second fixing hole 700*b* is provided between the center through-hole 70*c* and the lower-end through-hole 70*b*. Fixing members (not shown) used for fixing the window power feed wire 6 to the flat-plate portion 700 are fixed in the first and second fixing holes 700*a* and 700*b*. Thus, the window power feed wire 6 routed on the rail portion 70 is prevented from being slack. Although two fixing holes, the first fixing hole 700*a* and the second fixing hole 700*b*, are provided at symmetric positions in the longitudinal direction of the rail portion 70 in this example, the number of the fixing holes or the positions thereof on the rail portion 70 may be changed as needed.

The window power feed wire 6 is sandwiched between the first and second side plate portions 701 and 702 and is inserted through an insertion portion 70*d* which is a space extending in the longitudinal direction. In other words, the window power feed wire 6 is routed between the upper and lower ends of the rail portion 70 along the longitudinal direction of the rail portion 70.

Figure 13A:
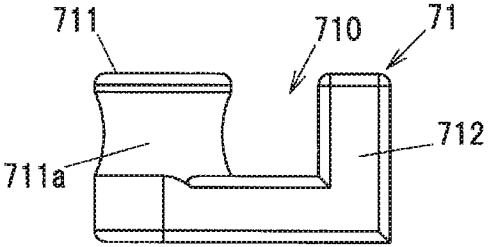
Figure 13E:
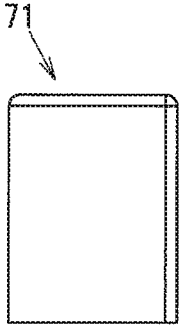
Figure 13B:
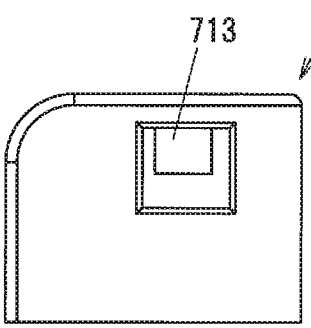
Figure 13D:
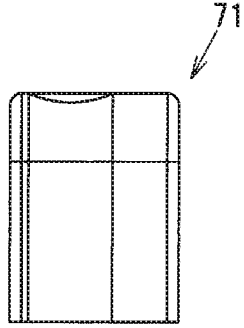
Figure 13F:
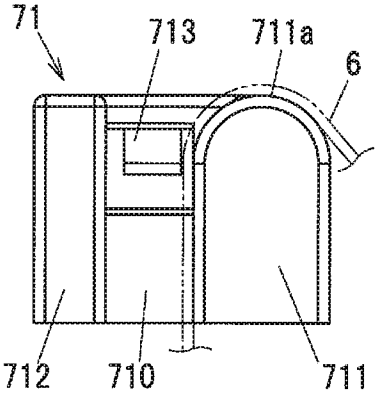
Figure 13C:
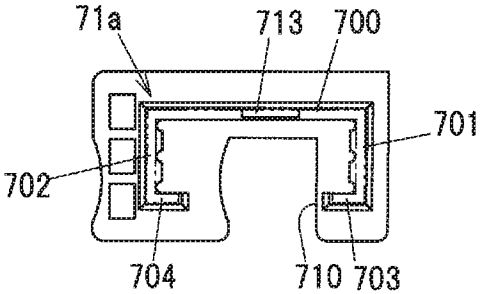
Figure 12:
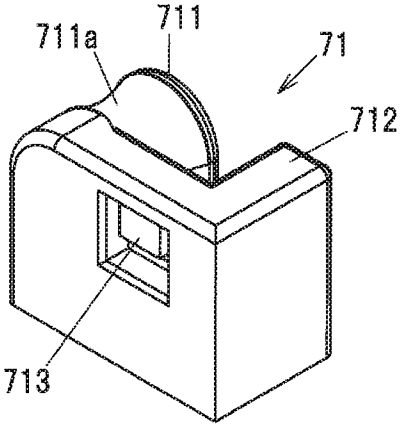
FIG. 12 is a perspective view showing a configuration of an upper end cover of the swing bar.

FIG. 12 is a perspective view showing a configuration of the upper end cover 71 of the swing bar 7. FIGS. 13A to 13F are two-dimensional diagrams illustrating the configuration of the upper end cover 71, wherein FIG. 13A is a top view, FIG. 13B is a front view; FIG. 13C is a bottom view, FIG. 13D is a left side view, FIG. 13E is a right side view and FIG. 13F is a back view.

The upper end cover 71 is a resin member having a substantially rectangular parallelepiped shape as a whole. The upper end cover 71 has a wire support portion 711 for supporting the window power feed wire 6 in tension, a space 710 as an exit for the window power feed wire 6 extending out of the rail portion 70, and a sidewall portion 712 positioned so that the space 710 is sandwiched between the wire support portion 711 and the sidewall portion 712.

The wire support portion 711 is formed so that an end portion thereof has an arc shape. This allows the window power feed wire 6 to smoothly extend out of the upper end cover 71. Thus, excessive bend and resulting wire breakage are prevented at a portion where the window power feed wire 6 extending out of the upper end cover 71 turns to change the direction.

A fitting groove 71*a* for fitting the rail portion 70 is formed on the bottom surface of the upper end cover 71. The upper end cover 71 also has an upper-end fitting portion 713 which is fitted to the upper-end through-hole 70*a* of the rail portion 70. When attaching the upper end cover 71 to the rail portion 70, the upper-end fitting portion 713 of the upper end cover 71 is fitted to the upper-end through-hole 70*a* of the rail portion 70 only by sliding the upper end of the rail portion 70 into the fitting groove 71*a* of the upper end cover 71, hence, easy assembly. In case that the swing bar 7 is formed of a resin, it is possible to integrally mold the upper end cover 71 and the rail portion 70 of the swing bar 7.

Figure 15A:
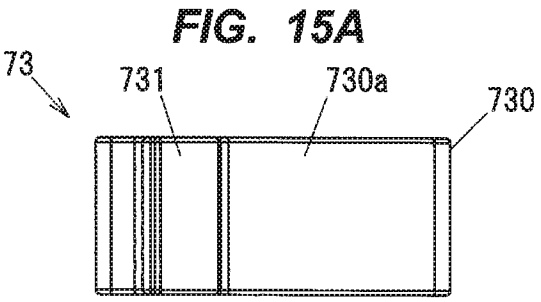
Figure 15B:
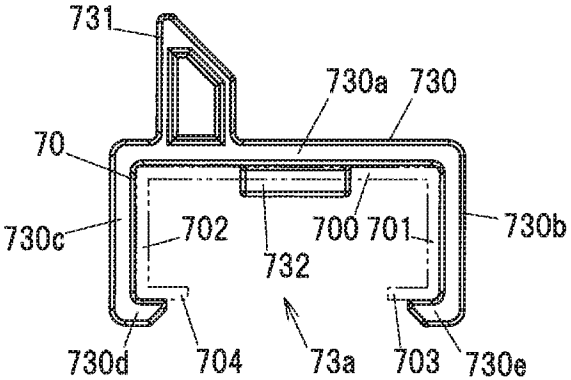
Figure 15C:
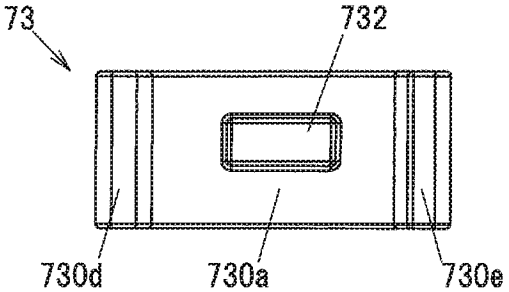
Figure 15D:
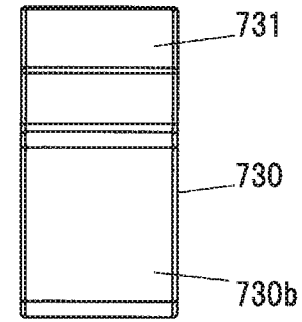
Figure 14:
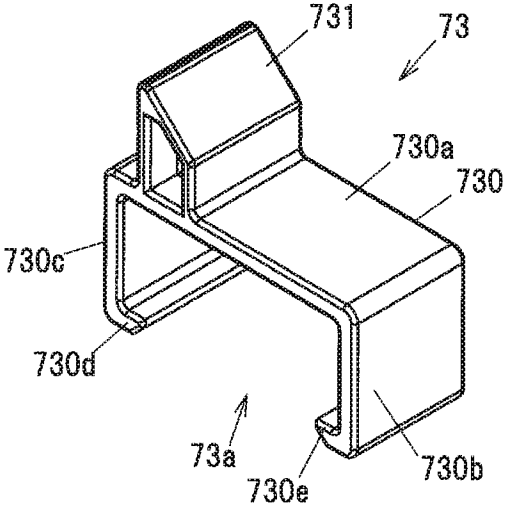
FIG. 14 is a perspective view showing a configuration of a locking portion of the swing bar.

FIG. 14 is a perspective view showing a configuration of the locking portion 73 of the swing bar 7. FIGS. 15A to 15D are two-dimensional diagrams illustrating the configuration of the locking portion 73, wherein FIG. 15A is a front view, FIG. 15B is a bottom view, FIG. 15C is a back view and FIG. 15D is a right side view.

The locking portion 73 is a resin member and integrally has a main body 730 having a squared U-shaped cross section, and a temporary holding portion 731 locked to the protrusion 35 of the carrier plate 3 in the initial state which is immediately after installing the window regulator 1 to the door panel.

The main body 730 has a flat-plate portion 730*a* having the temporary holding portion 731 on the outer surface, first and second wall portions 730*b* and 730*c*, and first and second claw portions 730*d* and 730*e*. A space between the first and second claw portions 730*d* and 730*e* is formed as an opening 73*a*.

As shown in FIGS. 15B and 15C, a center fitting portion 732 to be fitted to the center through-hole 70*c* of the rail portion 70 is provided on the inner surface of the flat-plate portion 730*a*. The center fitting portion 732 protrudes in a raised manner from the inner surface of the flat-plate portion 730*a*. The locking portion 73 is positioned with respect to the rail portion 70 by fitting the center fitting portion 732 of the locking portion 73 to the center through-hole 70*c* of the rail portion 70.

When attaching the locking portion 73 to the rail portion 70, the center fitting portion 732 of the locking portion 73 is fitted to the center through-hole 70*c* of the rail portion 70 while elastically deforming the first and second wall portions 730*b* and 730*c* of the locking portion 73 so that the opening 73*a* of the locking portion 73 is widened. The locking portion 73 is thereby attached to the rail portion 70.

In this state, the inner surfaces of the first and second claw portions 730*d* and 730*e* of the locking portion 73 are in contact with the outer surfaces of the first and second flange portions 703 and 704 of the rail portion 70, which prevents the locking portion 73 from slipping out of the rail portion 70 in a direction orthogonal to the flat-plate portion 730*a*.

Figure 16A:
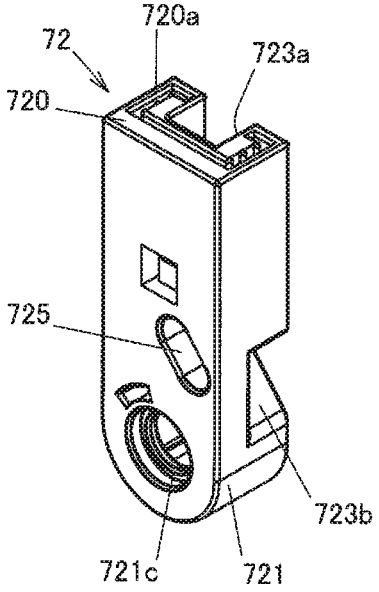
FIGS. 16A and 16B are perspective views showing a configuration of a lower end cover of the swing bar.
Figure 16B:
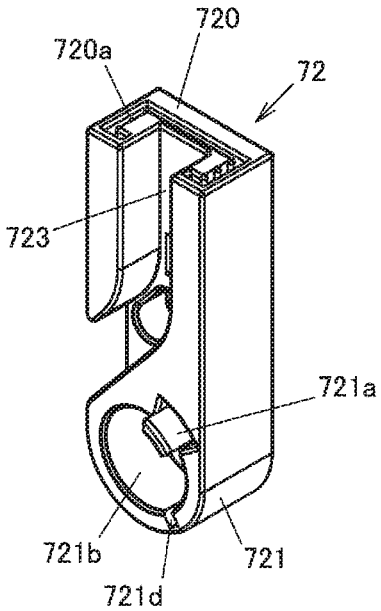
Figure 17A:
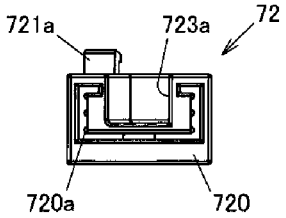
Figure 17B:
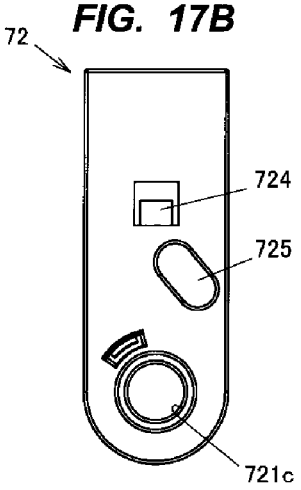
Figure 17D:
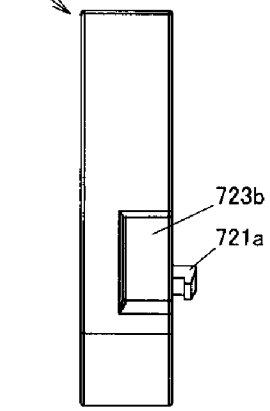
Figure 17E:
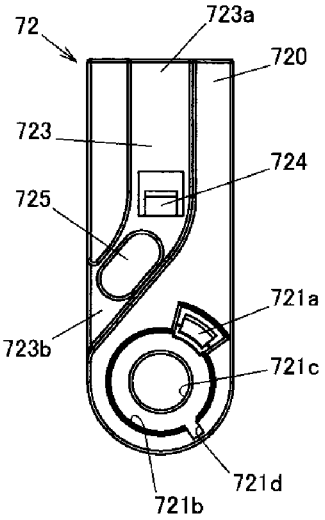
Figure 17C:
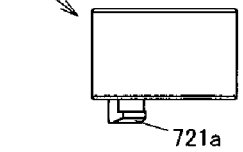

FIGS. 16A and 16B are perspective views showing a configuration of the lower end cover 72 of the swing bar 7. FIGS. 17A to 17E are two-dimensional diagrams illustrating the configuration of the lower end cover 72, wherein FIG. 17A is a top view, FIG. 17B is a front view, FIG. 17C is a bottom view, FIG. 17D is a right side view and FIG. 17E is a back view.

The lower end cover 72 is a resin member and has a rail support portion 720 for supporting the rail portion 70 of which lower end is fitted thereto, an attached portion 721 located at the lower end of the rail support portion 720 and rotatably attached to the drum housing 53, and a window power feed wire-exit portion 723 from which the window power feed wire 6 routed along the rail portion 70 extends out toward the power supply connector 520. A lower-end fixing hole 725 used for fixing the window power feed wire 6 to the lower end cover 72 is formed on the window power feed wire-exit portion 723 of the lower end cover 72, and a fixing member (not shown) used for fixing the window power feed wire 6 is fixed in the lower-end fixing hole 725.

The rail support portion 720 of the lower end cover 72 has a fitting hole 720*a* to which the lower end of the rail portion 70 is fitted.

The window power feed wire-exit portion 723 of the lower end cover 72 is a groove which is a recess on a surface of the rail support portion 720 facing the rail portion 70. At the window power feed wire-exit portion 723, the window power feed wire 6 is inserted from an insertion entrance 723*a* which is an opening on the upper surface of the rail support portion 720, and the window power feed wire 6 extends out from an exit 723*b* formed on a side surface of the rail support portion 720.

The attached portion 721 of the lower end cover 72 is provided with the stopper 721*a* to be inserted into the through-hole 535*a* of the base portion 535 of the drum housing 53, a cylindrical housing portion 721*b* for accommodating the elastic member 8, an insertion hole 721*c* which is in communication with the housing portion 721*b* and into which the shaft portion 536 of the drum housing 53 is inserted, and a spring locking groove 721*d* locking the other end of the elastic member 8. The elastic member 8 is coupled to the shaft portion 536 of the drum housing 53 at one end and is locked in the spring locking groove 721*d* of the lower end cover 72 at the other end.

A lower-end fitting portion 724 to be fitted to the lower-end through-hole 70*b* of the rail portion 70 is provided on the lower end cover 72. This facilitates the positioning of the lower end cover 72 with respect to the rail portion 70. In case that the swing bar 7 is formed of a resin, it is possible to integrally mold the lower end cover 72 and the rail portion 70 of the swing bar 7.

The stopper 721*a* of the lower end cover 72 is arranged movable in the through-hole 535*a* between one end and the other end in the circumferential direction thereof. In other words, the lower end cover 72 swings in a range in which the stopper 721*a* thereof moves in the through-hole 535*a* of the drum housing 53.

(Motion of the Window Regulator)

Figure 18A:
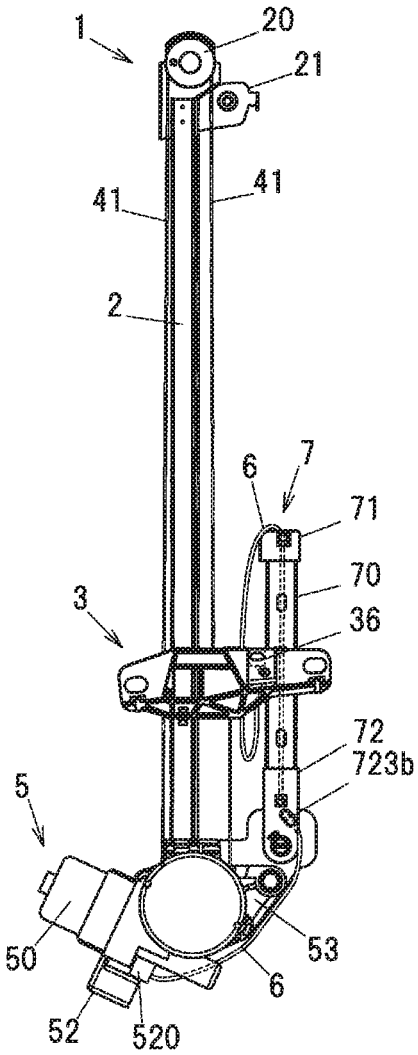
FIGS. 18A to 18D are explanatory diagrams illustrating motion of the window regulator, particularly, motion of the swing bar with movement of the carrier plate, wherein FIG.
Figure 18B:
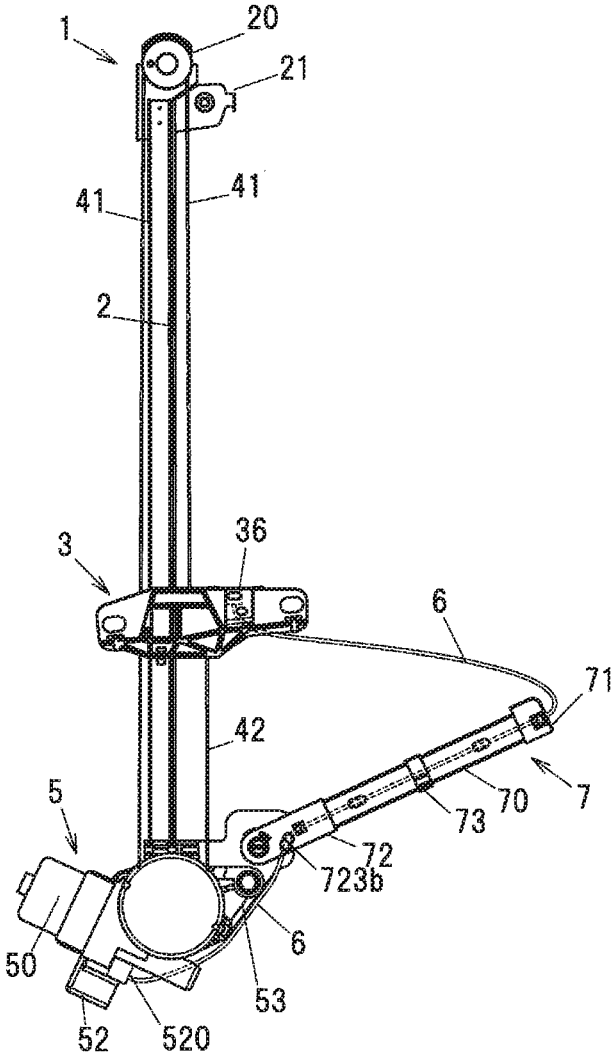
Figure 18C:
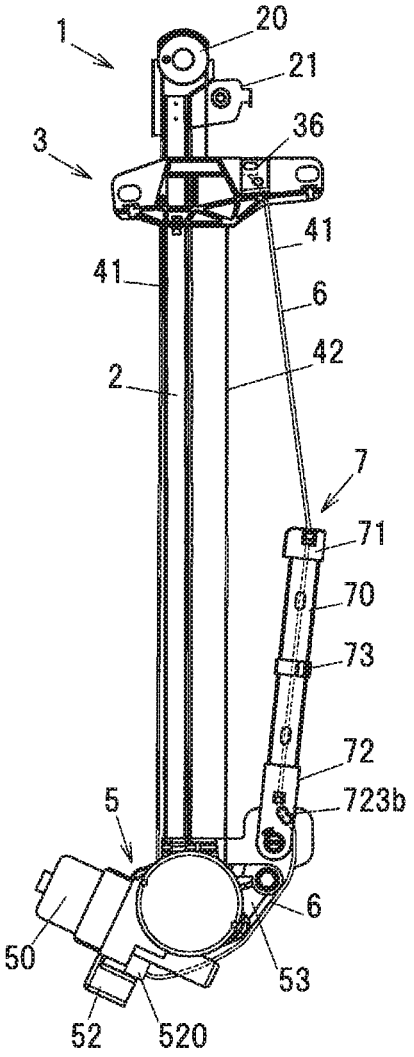
Figure 18D:
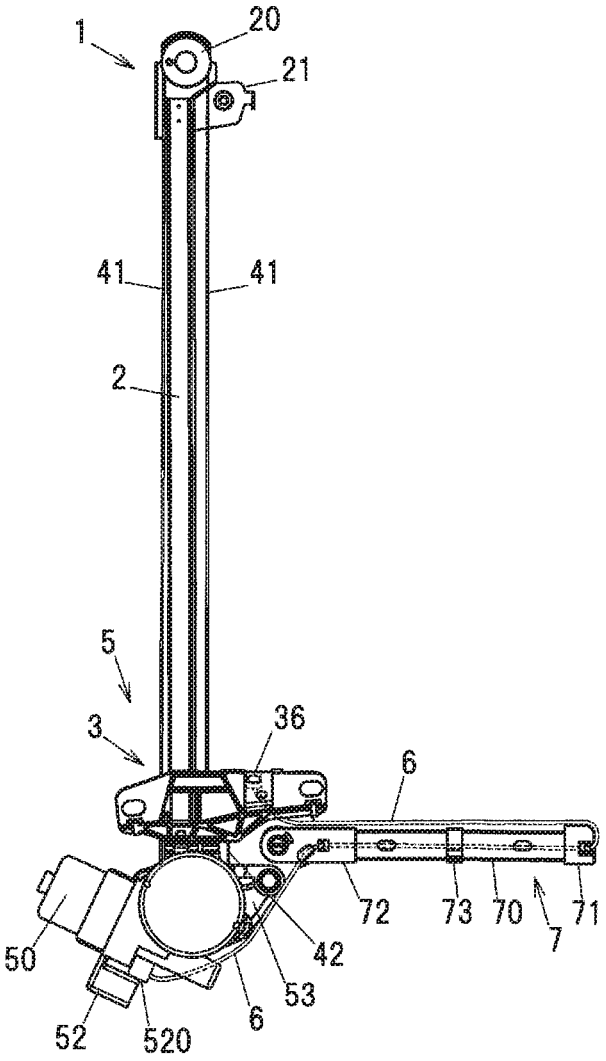

Next, motion of the window regulator 1 will be described in reference to FIG. 18. FIGS. 18A to 18D are explanatory diagrams illustrating motion of the window regulator 1, particularly, motion of the swing bar 7 with movement of the carrier plate 3, wherein FIG. 18A shows the temporarily held state, FIG. 18B shows the state immediately after the carrier plate 3 started to move upward from the temporarily held state, FIG. 18C shows the state in which the carrier plate 3 is located at its top dead center, and FIG. 18D shows the state in which the carrier plate 3 is located at its bottom dead center. In FIGS. 18A to 18D, illustration of the window 90 is omitted for convenience of explanation.

Here, the top dead center is the position of the carrier plate 3 with respect to the guide rail 2 when the window 90 is fully closed, and the bottom dead center is the position of the carrier plate 3 with respect to the guide rail 2 when the window 90 is fully opened. In addition, the initial state means, e.g., a state immediately after the window regulator 1 is attached to the door panel.

In the temporarily held state, the swing bar 7 is in the third position/orientation and extends along the longitudinal direction of the guide rail 2, as shown in FIG. 18A. In this state, engagement between the protrusion 35 of the carrier plate 3 and the temporary holding portion 731 of the locking portion 73 of the swing bar 7 keeps the swing bar 7 in the third position/orientation. This reduces the size of the window regulator 1 in the vehicle longitudinal direction, thereby preventing the swing bar 7 from coming into contact with other components at the time of installing the window regulator 1 to the door panel.

The window power feed wire 6 is connected to the power feed connector 36 of the carrier plate 3 at one end and to the power supply connector 520 of the motor housing 52 at the other end.

In more detail, the window power feed wire 6 extending out of the power feed connector 36 is inserted into the upper end cover 71 of the swing bar 7, is routed along the rail portion 70, and exits from the exit 723*b* of the lower end cover 72. The window power feed wire 6 extending out from the exit 723*b* is routed to the power supply connector 520 along the side portion of the drum housing 53.

In the initial state, the window power feed wire 6 routed between the power feed connector 36 and the upper end cover 71 of the swing bar 7 is slack, and in this state, no tension is applied to the window power feed wire 6.

As shown in FIG. 18B, when the carrier plate 3 moves upward, the protrusion 35 of the carrier plate 3 is disengaged from the temporary holding portion 731 of the locking portion 73 of the swing bar 7, and the swing bar 7 swings in the second direction from the third position/orientation due to the elastic force of the elastic member 8. This releases the temporarily held state. Although the example when moving up the carrier plate 3 is described in reference to FIG. 18B, it is possible to release the temporarily held state by moving down the carrier plate 3.

At this time, since the swing bar 7 swings in the second direction by the length of slack of the window power feed wire 6, the slack of the window power teed wire 6 is removed and tension is applied to the window power feed wire 6. As such, in the first embodiment, the carrier plate 3 and the swing bar 7 are set in the temporarily held state as the initial state and, when the carrier plate 3 moves upward from the initial state by a certain amount, the temporarily held state is automatically released and tension is applied to the window power feed wire 6. In more detail, tension is applied to the window power feed wire 6 between the fixing member provided on the carrier plate 3 to fix the window power feedwire 6 and the fixing member fixed in the first fixing hole 700*a* of the swing bar 7 to fix the window power feed wire 6.

The elastic force of the elastic member 8 in the second direction is set so that oscillation of the swing bar 7 due to the elastic force does not impede upward movement of the carrier plate 3.

When the carrier plate 3 further moves upward from the state shown in FIG. 18B while the window power feed wire 6 is in tension, the force of moving up the carrier plate 3 is transferred to the swing bar 7 via the window power feed wire 6. Thus, the swing bar 7 swings in the first direction due to the upward movement of the carrier plate 3.

As such, when the carrier plate 3 moves upward, the swing bar 7 receiving an elastic force of the elastic member 8 is pivoted in the first direction by the carrier plate 3 and tension is applied to the window power feed wire 6, hence, the window power feed wire 6 does not become slack.

Then, when the carrier plate 3 is located at the top dead center, the swing bar 7 is in the first position/orientation, as shown in FIG. 18C. Also in this state, since the swing bar 7 constantly receives the elastic force in the second direction from the elastic member 8, the window power feed wire 6 is kept in tension and the slack of the window power feed wire 6 is prevented.

When the carrier plate 3 moves downward, the swing bar 7 swings in the second direction with downward movement of the carrier plate 3 since the swing bar 7 constantly receives the elastic force in the second direction from the elastic member 8. Thus, the window power feed wire 6 is kept in tension and the window power feed wire 6 does not become slack.

Then, when the carrier plate 3 is located at the bottom dead center, the swing bar 7 is in the second position/orientation, as shown in FIG. 18D. Also in this state, since the swing bar 7 constantly receives the elastic force in the second direction from the elastic member 8, the window power feed wire 6 is kept in tension and the slack of the window power feed wire 6 is prevented.

In the first embodiment described above, by providing the swing bar 7 with the window power feed wire 6 arranged thereon along the longitudinal direction and the elastic member 8 for applying an elastic force in the second direction to the swing bar 7, the swinging force of the swing bar 7 in the second direction is converted into tension of the window power feed wire 6 and the slack of the window power feed wire 6 is removed. This prevents a phenomenon in which, e.g., the window power feed wire 6 comes into contact with other components inside the door panel and makes noise when closing the door, which would happen when the window power feed wire 6 is slack.

In the first embodiment, since it is configured that the carrier plate 3 and the swing bar 7 are connected via the window power feed wire 6 and the swing bar 7 constantly receives the elastic force in the second direction, tension is constantly applied to the window power feed wire 6. That is, with the vertical movement of the carrier plate 3, the swing bar 7 swings in a direction of applying tension to the window power feed wire 6. This eliminates necessity of a complicated structure such as a wire reel used in the window regulator described in JP H1/154788U, and it is possible to remove the slack of the window power feed wire 6 with a simple structure.

Meanwhile, power could be wirelessly supplied to the window 90, but in this case, power to be supplied is large and this leads to an increase in size of the entire device. The first embodiment using a wired power supply means does not lead to such an increase in size.

In addition, in the first embodiment, the window power feed wire 6 can be routed only by connecting the window power feed wire 6 to the power supply connector 520 and the power feed connector 36 and attaching a portion of the window power feed wire 6 to the swing bar 7. That is, work of, e.g., taking up the window power feed wire 6 is not necessary unlike the wire reel in JP H1/154788U, and it is thus easy to route the window power feed wire 6.

Second Embodiment

Figure 19C:
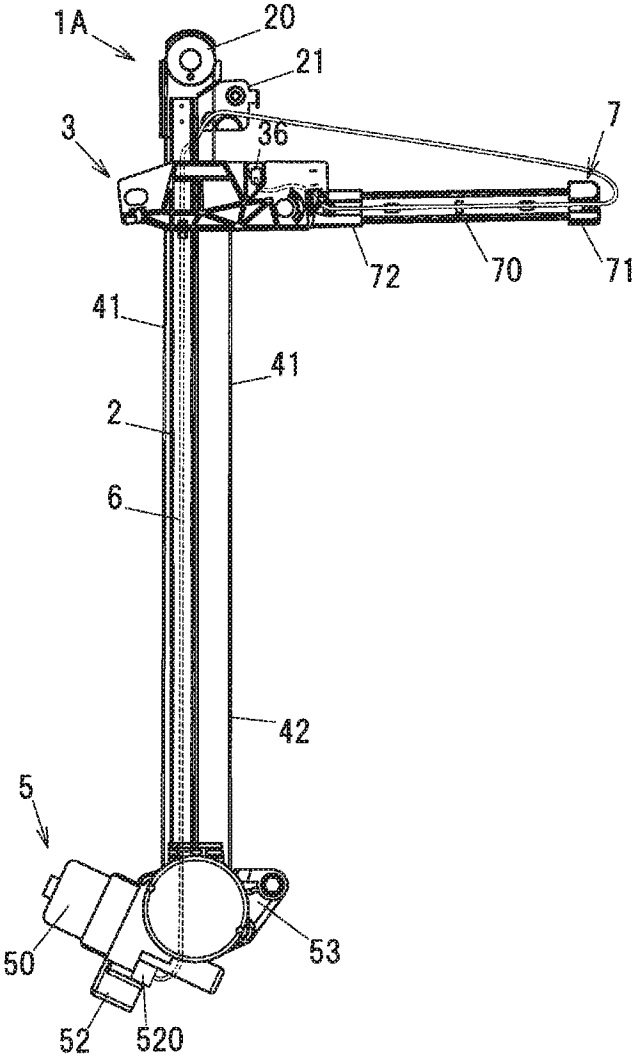
Figure 19B:
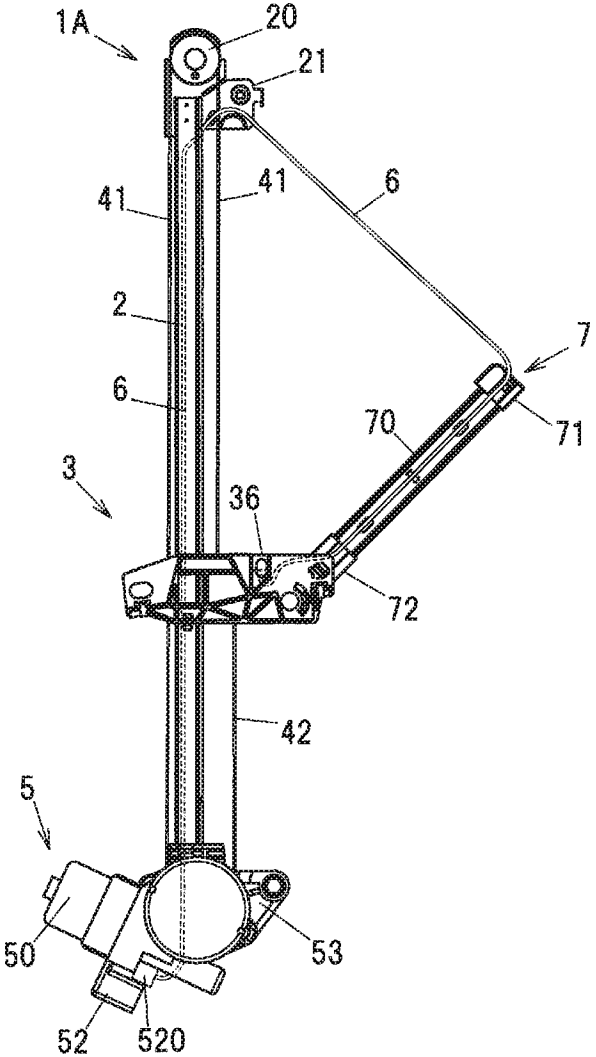
Figure 19A:
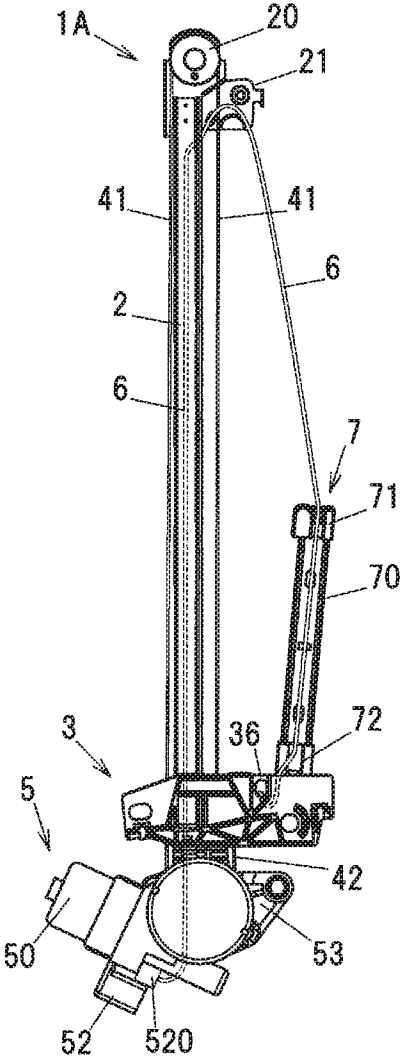
Figure 21B:
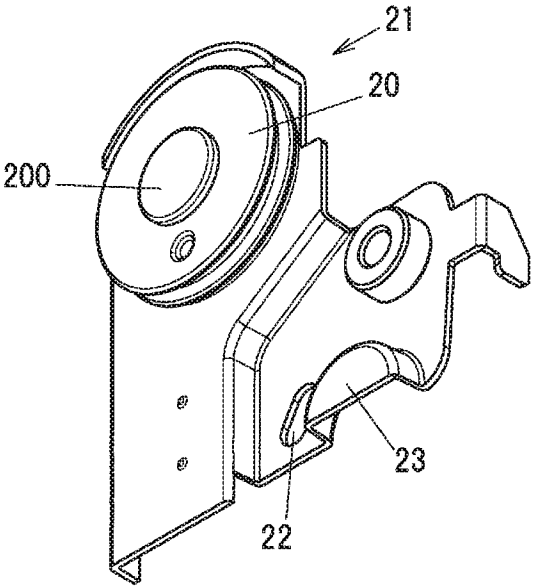
FIGS. 21A and 21B are perspective views showing the configuration of the pulley bracket.
Figure 21A:
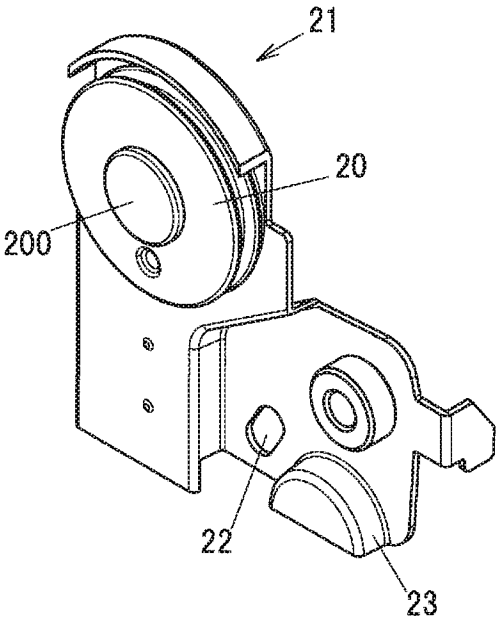
Figure 20A:
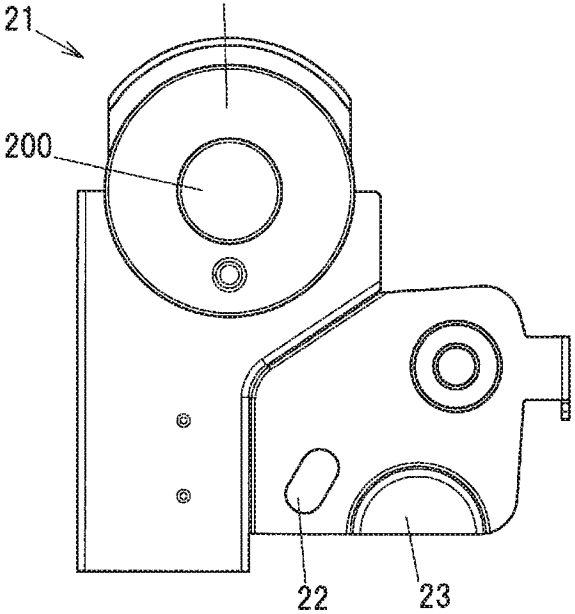
Figure 20B:
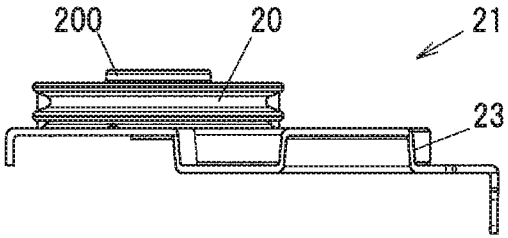

Next, a window regulator 1A in the second embodiment will be described in reference to FIG. 19. FIGS. 19A to 19C are explanatory diagrams illustrating motion of the window regulator 1A, particularly, motion of the swing bar 7 with movement of the carrier plate 3, wherein FIG. 19A shows the state in which the carrier plate 3 is located at the bottom dead center, FIG. 19B shows the state in which the carrier plate 3 is located at an intermediate position between the top dead center and the bottom dead center, and FIG. 19C shows the state in which the carrier plate 3 is located at the top dead center. In FIGS. 19A to 19C, illustration of the window 90 is omitted for convenience of explanation.

The window regulator 1A in the second embodiment has the same configuration as the window regulator 1 in the first embodiment, except the mounting position of the swing bar 7.

The swing bar 7 in the second embodiment is configured such that the lower end cover 72 as a swingably supported portion is arranged on the carrier plate 3. In the second embodiment, the swing bar 7 is swingable between the first position/orientation, which corresponds to the bottom dead center of the carrier plate 3 and at which the swing bar 7 extends along the longitudinal direction of the guide rail 2, and the second position/orientation, which corresponds to the top dead center of the carrier plate 3 and at which the swing bar 7 is inclined at 90° in the second direction from the first position/orientation and extends along the horizontal direction. Although the predetermined angular range between the first position/orientation and the second position/orientation is about 90° in the second embodiment, the swingable angular range of the swing bar 7 is not limited thereto and is changed as needed.

The window power feed wire 6 extending out of the power feed connector 36 of the carrier plate 3 is inserted into the lower end cover 72 of the swing bar 7 and is routed along the rail portion 70. The window power feed wire 6 routed on the rail portion 70 extends out of the upper end cover 71, passes a fixing member (described later) provided to fix the window power feed wire 6 to the pulley bracket 21, is then routed along the longitudinal direction of the guide rail 2 toward the lower end of the guide rail 2 while being supported by a guide rail support portion (not shown) on a surface of the guide rail 2 opposite to the surface on which the carrier plate 3 slides, and is connected to the power supply connector 520 of the motor housing 52. The pulley bracket 21 has a bracket fixing hole 22 used for fixing the window power feed wire 6 to the pulley bracket 21, and the fixing member (not shown) for fixing the window power feed wire 6 is fixed in the bracket fixing hole 22. Furthermore, the pulley bracket 21 has a bracket wire support portion 23 which is formed in an arc shape to support the window power feed wire 6 in tension. This allows the window power feed wire 6 to smoothly extend out of the pulley bracket 21. Thus, excessive bend and resulting wire breakage are prevented at a portion where the window power feed wire 6 extending out of the pulley bracket 21 turns to change the direction.

In the second embodiment, the elastic member 8 applies an elastic force to the swing bar 7 in the second direction in which the upper end cover 71 moves away from the guide rail 2.

When the carrier plate 3 is located at the bottom dead center, the swing bar 7 is in the first position/orientation, as shown in FIG. 19A. In this state, since the swing bar 7 constantly receives the elastic force in the second direction from the elastic member 8, the window power feed wire 6 is kept in tension and the slack of the window power feed wire 6 is prevented. In more detail, tension is applied to the window power feed wire 6 between the fixing member provided on the pulley bracket 21 to fix the window power feed wire 6 and the fixing member fixed in the first fixing hole 700*a* of the swing bar 7 to fix the window power feed wire 6.

As shown in FIG. 19B, when the carrier plate 3 moves upward, the swing bar 7 swings in the second direction to maintain tension acting on the window power feed wire 6 between the upper end of the guide rail 2 and the upper end cover 71 of the swing bar 7 since the swing bar 7 constantly receives the elastic force in the second direction from the elastic member 8. Thus, tension is applied to the window power feed wire 6 also during upward movement of the carrier plate 3.

Then, when the carrier plate 3 is located at the top dead center, the swing bar 7 is in the second position/orientation, as shown in FIG. 19C. Also in this state, since the swing bar 7 constantly receives the elastic force in the second direction from the elastic member 8, the window power feed wire 6 is kept in tension and the slack of the window power feed wire 6 is prevented.

When the carrier plate 3 moves downward from the top dead center, the swing bar 7 swings in the first direction against the elastic force of the elastic member 8 due to tension of the window power feed wire 6, and then, the carrier plate 3 reaches the bottom dead center and the swing bar 7 is back in the first position/orientation.

As such, in the second embodiment, with the movement of the carrier plate 3, the swing bar 7 swings so that tension is constantly applied to the window power feed wire 6. Therefore, the second embodiment also provides the same effects as the first embodiment.

Third Embodiment

Figure 22C:
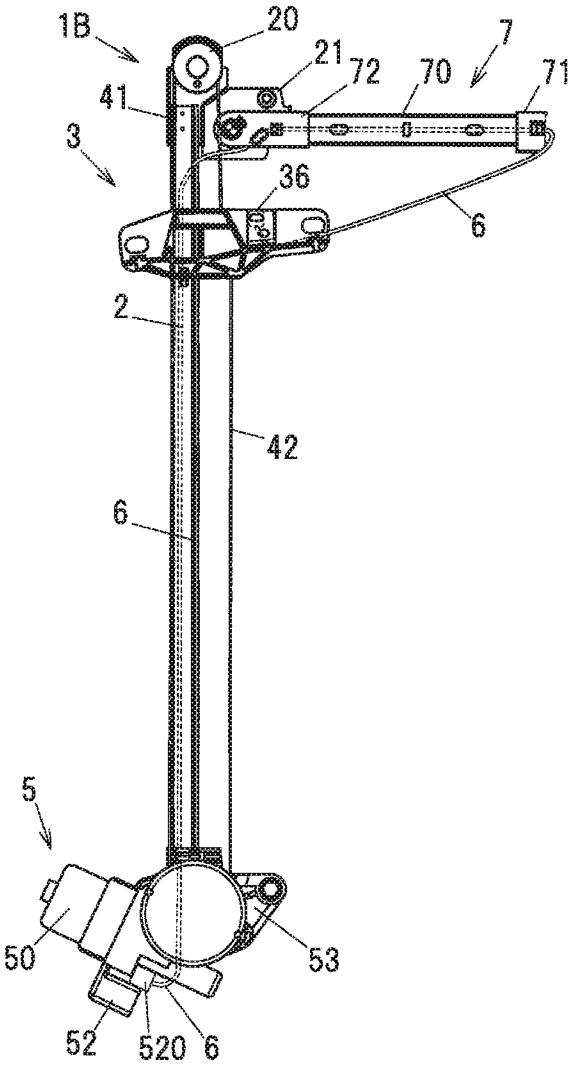
Figure 22B:
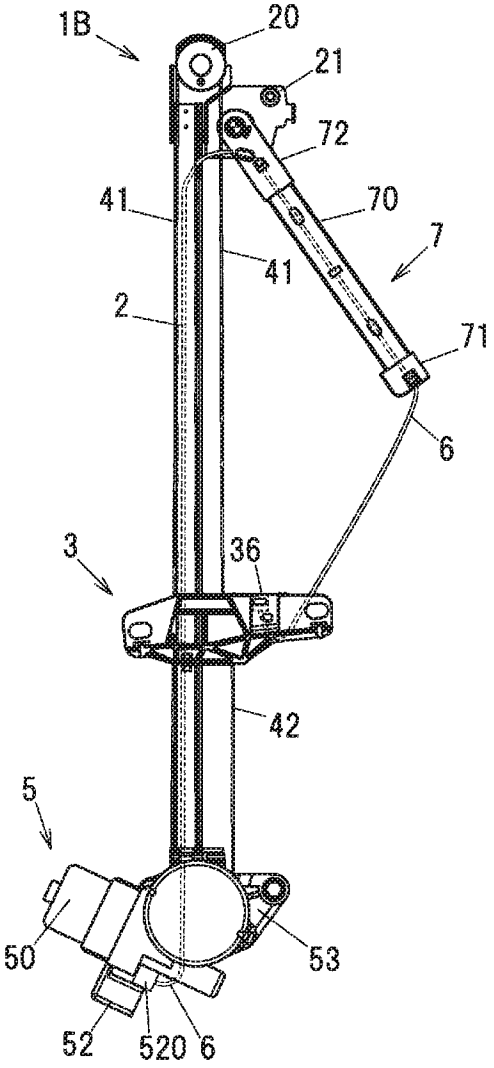
Figure 22A:
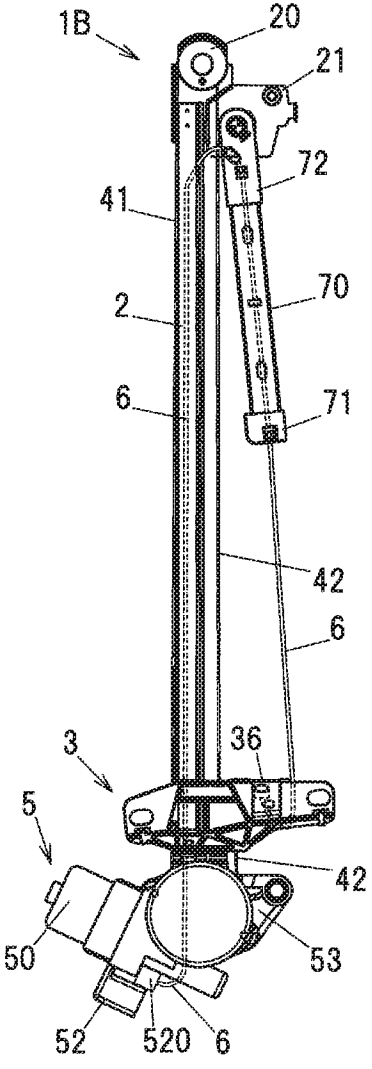

Next, a window regulator 1B in the third embodiment will be described in reference to FIG. 22. FIGS. 22A to 22C are explanatory diagrams illustrating motion of the window regulator 1B, particularly, motion of the swing bar 7 with movement of the carrier plate 3, wherein FIG. 22A shows the state in which the carrier plate 3 is located at the bottom dead center, FIG. 22B shows the state in which the carrier plate 3 is located at an intermediate position between the top dead center and the bottom dead center, and FIG. 22C shows the state in which the carrier plate 3 is located at the top dead center. In FIGS. 22A to 22C, illustration of the window 90 is omitted for convenience of explanation.

The window regulator 1B in the third embodiment has the same configuration as the window regulator 1 in the first embodiment, except the mounting position of the swing bar 7.

The swing bar 7 in the third embodiment is configured such that the lower end cover 72 as a swingably supported portion is arranged on the pulley bracket 21 located on the upper end of the guide rail 2. The swing bar 7 is swingable between the first position/orientation, which corresponds to the bottom dead center of the carrier plate 3 and is along the guide rail 2, and the second position/orientation, which corresponds to the dead bottom dead center of the carrier plate 3 and at which the swing bar 7 is inclined at 90° from the first position/orientation and is away from the guide rail 2 along the horizontal direction. Although the predetermined angular range between the first position/orientation and the second position/orientation is about 90° in the third embodiment, the swingable angular range of the swing bar 7 is not limited thereto and is changed as needed.

The window power feed wire 6 extending out of the power feed connector 36 of the carrier plate 3 is inserted into the upper end cover 71 of the swing bar 7, is routed along the rail portion 70 and extends out of the lower end cover 72. The window power feed wire 6 extending out of the lower end cover 72 is routed from the upper end side of the guide rail 2 along the longitudinal direction of the guide rail 2 toward the lower end of the guide rail 2 while being supported by the guide rail support portion (not shown) on the surface of the guide rail 2 opposite to the surface on which the carrier plate 3 slides, and is connected to the power supply connector 520 of the motor housing 52.

In the third embodiment, the elastic member 8 applies an elastic force to the swing bar 7 in the second direction in which the upper end cover 71 moves away from the guide rail 2.

When the carrier plate 3 is located at the bottom dead center, the swing bar 7 is in the first position/orientation, as shown in FIG. 22A. In this state, since the swing bar 7 constantly receives the elastic force in the second direction from the elastic member 8, the window power feed wire 6 is kept in tension and the slack of the window power feed wire 6 is prevented. In more detail, tension is applied to the window power feed wire 6 between the fixing member provided on the carrier plate 3 to fix the window power feed wire 6 and the fixing member fixed in the first fixing hole 700*a* of the swing bar 7 to fix the window power feed wire 6.

When the carrier plate 3 moves upward, the swing bar 7 swings toward the second position/orientation due to the elastic force of the elastic member 8 to maintain tension acting on the window power feed wire 6 between the power feed connector 36 of the carrier plate 3 and the upper end cover 71 of the swing bar 7, shown in FIG. 22B.

When the carrier plate 3 further moves upward and the carrier plate 3 reaches the top dead center, the swing bar 7 is in the second position/orientation, as shown in FIG. 22C, Also in this state, since the swing bar 7 constantly receives the elastic force in the second direction from the elastic member 8, the swing bar 7 is held in the second position/orientation. Thus, the window power feed wire 6 is kept in tension and the slack of the window power feed wire 6 is prevented.

When the carrier plate 3 located at the top dead center moves downward, the swing bar 7 swings in the first direction due to tension of the window power feed wire 6, and then, the carrier plate 3 reaches the bottom dead center and the swing bar 7 is back in the first position/orientation.

As such, in the third embodiment, with the movement of the carrier plate 3, the swing bar 7 swings so that tension is constantly applied to the window power feed wire 6. Therefore, the third embodiment also provides the same effects as the first embodiment.

Although the embodiments of the invention have been described, the invention according to claims is not to be limited to the embodiments. For example, although the example of applying the invention to the window regulator 1 of so-called lower end drive type with the drive unit 5 provided at the lower end of the guide rail 2 has been described, it is not limited thereto. The invention is also applicable to a delta-type window regulator having the drive unit 5 separately from the guide rail 2, a window regulator having the drive unit 5 attached to the middle of the guide rail 2, a self-propelled window regulator with the drive unit 5 moving on the guide rail 2, and a dual rail window regulator provided with two guide rails 2.

Also, although the examples of attaching the lower end cover 72 of the swing bar 7 to the lower end side of the guide rail 2, to the upper end side of the guide rail 2 and to the carrier plate 3 have been described in the first to third embodiments, the mounting position of the swing bar 7 is not limited thereto. For example, the lower end cover 72 of the swing bar 7 may be attached to the drum housing 53 of the drive unit 5 in a delta-type window regulator having the drive unit 5 separately from the guide rail 2 or in a dual rail window regulator. For example, the lower end cover 72 of the swing bar 7 may be provided at the longitudinal center of the guide rail 2. In this case, the lower end cover 72 of the swing bar 7 is attached to a bracket fixed to the guide rail 2.

Also, the swing bar 7 in the embodiments may be provided with a positioning mechanism capable of positioning the upper end cover 71 with respect to the rail portion 70. This positioning mechanism has the rail portion 70 having plural positioning holes formed along the longitudinal direction and the upper end cover 71 capable of sliding on the rail portion 70, and is configured that the upper end cover 71 is slid on the rail portion 70 at the time of attaching the upper end cover 71 to the rail portion 70, and the upper-end fitting portion 713 of the upper end cover 71 is fitted to any of the positioning holes on the rail portion 70. In other words, according to the required length of the swing bar 7, the upper end cover 71 is fixed to the rail portion 70 at a positioning hole corresponding to the required length. As a result, it is not necessary to manufacture the swing bar 7 for every size of the window regulator 1, hence, versatility is enhanced. Although slack of the window power feed wire 6 used for supplying power to the window 90 is removed in the embodiments, the intended use of the wire subjected to slack removal is not limited thereto. For example, it is applicable to remove slack of a communication wire used for transmitting/receiving signals to/from the window 90.

Also, please note that all combinations of the features described in the embodiments are not necessary to solve the problem of the invention. The invention can be appropriately modified and implemented without departing from the gist thereof.

The invention claimed is:

1. A window regulator, comprising:

a guide rail provided along an ascending direction and a descending direction of a window for a vehicle;

a carrier plate that slides on the guide rail and moves together with the window;

a window power feed wire for supplying power to the window;

a swing bar arranged to be swingable about a rotational axis thereof that is along a width direction of the vehicle; and an elastic member that generates an elastic force for oscillation of the swing bar in a predetermined direction;

wherein the window power feed wire is hung over the swing bar, and a tension is applied to the window power feed wire by oscillation of the swing bar due to the elastic force of the elastic member.

2. The window regulator according to claim 1, wherein the window power feed wire is routed between upper and lower ends of the swing bar along the longitudinal direction of the swing bar.

3. The window regulator according to claim 1, wherein a swingable supported end of the swing bar is provided on a lower end side of the guide rail.

4. The window regulator according to claim 1, wherein a swingably supported end of the swing bar is provided on an upper end side of the guide rail.

5. The window regulator according to claim 1, wherein a swingably supported end of the swing bar is provided on the carrier plate.

* * * * *